US007425363B2

(12) United States Patent
Kunimine et al.

(10) Patent No.: US 7,425,363 B2
(45) Date of Patent: Sep. 16, 2008

(54) LAMINATE FILM AND COMPOSITE STRUCTURE WITH IMAGED RECORDING MEDIUM

(75) Inventors: Noboru Kunimine, Tokyo (JP); Masaya Kobayashi, Yokohama (JP); Masami Tsukamoto, Yokohama (JP)

(73) Assignee: Canon Kabushiki Kaisha (JP)

( * ) Notice: Subject to any disclaimer, the term of this patent is extended or adjusted under 35 U.S.C. 154(b) by 83 days.

(21) Appl. No.: 11/316,613

(22) Filed: Dec. 22, 2005

(65) Prior Publication Data

US 2006/0156940 A1 Jul. 20, 2006

(30) Foreign Application Priority Data

Dec. 24, 2004 (JP) ..... 2004-374477
Dec. 20, 2005 (JP) ..... 2005-365915

(51) Int. Cl.
*B41M 5/00* (2006.01)
*B44C 1/17* (2006.01)
*G03G 7/00* (2006.01)

(52) U.S. Cl. ..... 428/195.1; 428/484.1; 428/488.11; 428/488.41; 428/913; 428/914

(58) Field of Classification Search ..... 428/195.1, 428/488.11, 488.41, 913, 914
See application file for complete search history.

(56) References Cited

U.S. PATENT DOCUMENTS

| | | | | |
|---|---|---|---|---|
| 4,234,644 | A * | 11/1980 | Blake et al. | 428/204 |
| 4,500,896 | A * | 2/1985 | Kubo et al. | 503/204 |
| 5,856,269 | A * | 1/1999 | Hayashi et al. | 503/227 |
| 5,932,325 | A * | 8/1999 | Ebihara et al. | 428/209 |
| 2002/0029713 | A1 * | 3/2002 | Morizumi et al. | 101/483 |
| 2002/0160160 | A1 * | 10/2002 | Suzuki et al. | 428/195 |
| 2003/0008116 | A1 * | 1/2003 | Williams et al. | 428/195 |

OTHER PUBLICATIONS

Polymer Chemistry—The Glass Transition, (last updated Jul. 11, 2000), at http://faculty.uscupstate.edu/llever/Polymer%20Resources/GlassTrans.htm.*

* cited by examiner

*Primary Examiner*—Callie E. Shosho
*Assistant Examiner*—David J Joy
(74) *Attorney, Agent, or Firm*—Rossi, Kimms & McDowell LLP.

(57) ABSTRACT

A laminate film for protecting a printed image formed on a recording medium by an ink-jet recording system, comprising a surface layer, an intermediate layer and a penetrative layer formed on a heat-resistant substrate in that order. The surface layer and the intermediate layer have a thermally softening property, the intermediate layer has a glass transition temperature lower than that of the surface layer, and the penetrative layer has a thermally melting property.

13 Claims, 3 Drawing Sheets

LAMINATE FILM AND COMPOSITE STRUCTURE WITH IMAGED RECORDING MEDIUM

BACKGROUND OF THE INVENTION

1. Field of the Invention

This invention relates to a laminate film for protecting printed images and imparting gloss to printed images. More particularly, the present invention relates to a laminate film for bringing an image formed by an ink-jet recording system using dye type ink materials into a state of being effectively kept out of external active gases (ozone gas, etc.) to improve the fading property of the image and an image protection method using the same.

2. Related Background Art

Ink-jet recording systems are known as a method of outputting photographs in place of silver halide photography. The initial image quality of images produced by the ink-jet recording system is comparable with that of photographs. However, in terms of preservability of image, it has been difficult to prevent image deterioration caused with the lapse of time. Specific problems that have to be dissolved for preserving images include that the UV resistance, the gas resistance and the water resistance of images have to be improved. Particularly, in the case of photographic images, the gas resistance of images desirably has to be improved because a poor gas resistance can be problematic in practical applications.

In the case of recorded images produced by ink-jet recording systems, the gas resistance of dyes in ink varies depending on the structure of an ink receiving layer of a recording medium where the image is recorded. The ink receiving layer of a swelling type recording medium swells to contain the dyes of the ink therein at the time of ink-jet recording so that the dyes can hardly fade. On the other hand, in the case of a void type recording medium dyes used for forming an image are attacked by active gases that penetrate through voids in the recording medium so that they are liable to fade.

However, from the viewpoint of high-speed printing, swelling type recording mediums are not suited for high speed printing because they poorly absorb ink. To the contrary, void type recording mediums are good for high speed printing because they have voids and hence they absorb ink excellently. While it may be conceivable to use pigment type ink in place of dye inks in order to avoid the problem of fading, pigment inks are accompanied by problems in terms of coloring effect.

Techniques for protecting an image by laminating an image formed surface of a recording medium after forming the image on it by means of an ink-jet recording system are known to improve the light resistance of the image when it is left outdoors and exposed to light for a long time (see Japanese Patent Application Laid-Open Nos. H7-156568, H8-224838 and H8-258210).

On the other hand, laminate films formed by arranging a peelable layer, a functional layer and a coating layer on a substrate are known (see Japanese Patent Application Laid-Open No. H11-348437).

However, when the image formed surface of a recording medium is laminated by a laminate film described in any of the techniques described in the above cited patent documents, pin holes can be produced on the image formed surface and active gases penetrate through the pin holes to fade the image. Additionally, when laminating an image formed surface of a recording medium where an image is printed without margins like a silver halide photograph, active gases can penetrate through the lateral edges of the recording medium to fade the image along the four sides (edges) thereof.

SUMMARY OF THE INVENTION

In view of the above-identified problems, it is therefore the object of the present invention to provide an image formed product that can suppress fading of the image caused by active gases. More particularly, the object of the present invention is to provide an image formed product, which is an ink-jet printed product provided with an ink receiving layer having numerous pores, that can effectively prevent fading during storage and maintain a good image quality so as to be stored safely for a long period of time even if the substrate causes expansion.

In an aspect of the present invention, the above object is achieved by providing a laminate film for protecting a printed image formed on a recording medium by an ink-jet recording system, comprising a surface layer, an intermediate layer and a penetrative layer formed on a heat-resistant substrate in that order, the surface layer and the intermediate layer having a thermally softening property, the glass transition temperature of the intermediate layer being lower than that of the surface layer, the penetrative layer having a thermally melting property.

In another aspect of the present invention, there is provided a method of protecting an image recorded on an ink-jet recording medium having a porous ink receiving layer by an ink-jet recording system, the method comprising a step of laying the above-described laminate film on the recording medium where the image is formed with the penetrative layer facing the recording medium, and a step of bringing the penetrative layer forming material into a liquid or fluid state by a heating means, allowing the material to penetrate into the voids of the ink receiving layer and subsequently solidifying the material.

Thus, according to the present invention, it is possible to provide a laminate film that can suppress fading, caused by active gases, of a printed product formed on a porous image receiving medium by means of an ink-jet recording system using dye inks. A laminate film according to the present invention can be handled with ease for use. The present invention also provides a method of excellently protecting a printed product in an easy manner.

DESCRIPTION OF THE PREFERRED EMBODIMENTS

Now, the present invention will be described in greater detail by referring to the accompanying drawings that illustrate preferred embodiments of the invention.

<Laminate Film>

Figure 2:
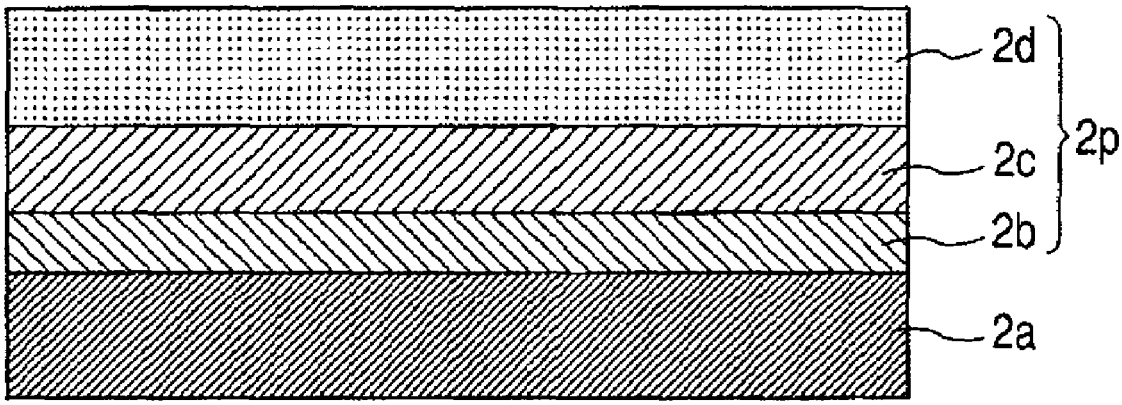
FIG. 2 is a schematic cross sectional view of a laminate film according to the invention.

FIG. 2 is a schematic cross sectional view of a laminate film according to the present invention. In FIG. 2, 2*a* denotes a heat-resistant substrate of the laminate film, 2*p* denotes an image protection layer of the laminate film. A laminate film 2 according to the invention is formed by sequentially laying a surface layer 2*b*, an intermediate layer 2*c* and a penetrative layer 2*d* on the heat-resistant substrate 2*a*.

<Image Protection Method>

FIGS. 3A, 3B, 3C and 3D schematically illustrate a method of forming the image protection layer 2*p* (gas blocking layer) on the image of an ink-jet printed product by means of a laminate film according to the invention. In FIGS. 3A, 3B, 3C and 3D, 2 denotes a laminate film according to the present invention and P denotes an image formed product in which an image has been formed by means of an ink-jet recording system on an ink-jet recording medium having a porous ink receiving layer (to be referred to as ink-jet printed product hereinafter).

Figure 3A:
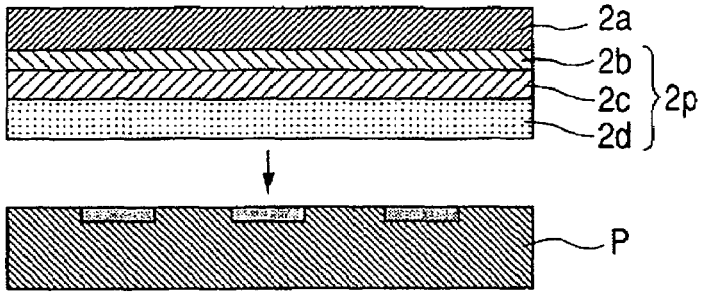
FIGS. 3A, 3B, 3C and 3D are schematic illustrations of a method of protecting the surface of an ink-jet printed product by means of a laminate film according to the present invention.
Figure 3B:
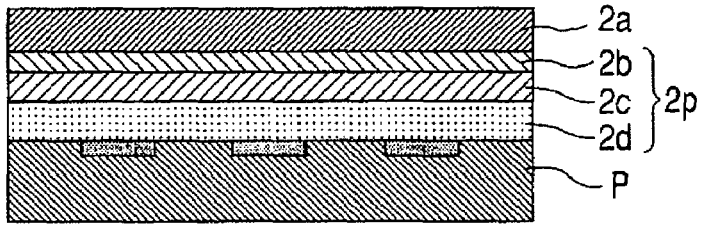

Firstly, a laminate film is laid on the surface where the image of the image product P has been formed (to be referred to as image formed surface hereinafter) with the penetrative layer 2*d* facing the image (see FIGS. 3A and 3B).

Figure 3C:
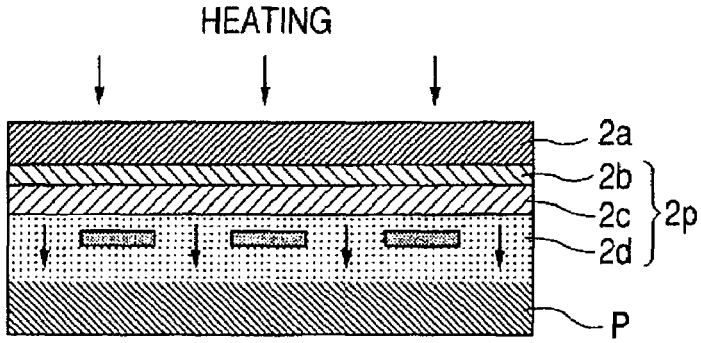
Figure 3D:
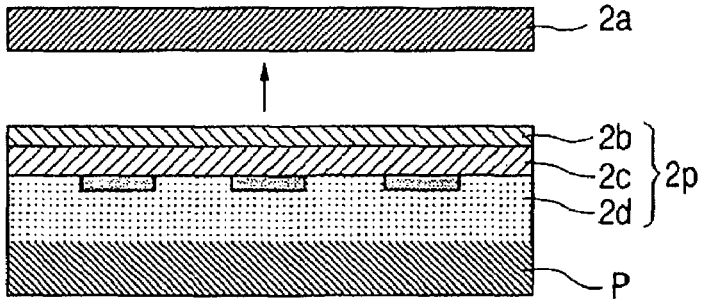

Then, the laminate film is heated from the side of the substrate 2*a* to melt the material that forms the penetrative layer (to be referred to as penetrative layer material hereinafter) (see FIG. 3C). The penetrative layer material that is molten to become liquid or fluid penetrates into voids of the ink receiving layer to fill the voids. Additionally, the surface layer 2*b* and the intermediate layer 2*c* are softened as a result of the heating to become adhering to the image formed surface of the ink-jet printed product P. Preferably, pressure is applied to the laminate film at the same time.

According to the present invention, since the penetrative layer material is preferably solidified at least in the outermost region of the image formed surface, the penetrative layer material preferably shows a relatively high viscosity in a molten state and is driven to penetrate into the void with ease under pressure.

The reason for solidifying the penetrative layer material in the outermost region of the image formed surface is as follows. Generally, a coloring material located away from the surface of a printed product does not contribute to the coloring effect of the image if compared with a coloring material located the outermost region. Light that is incident to the surface of the image formed surface strikes on the coloring material found in the ink receiving layer of the recording medium and diffuses and/or is absorbed to become attenuated. More specifically, light is attenuated as a function of the square of the distance from the image formed surface and hence the coloring material located away from the uppermost surface contributes to the optical density of the image only to a slight extent to the viewer's eyes. Therefore, for the present invention, it is preferable to conduct gas blocking with respect to the coloring material found near the uppermost surface of the ink receiving layer by means of the penetrative layer forming material. More specifically, it is preferable to fill the region at least up to a depth of 20 μm from the outermost surface of the ink receiving layer with the penetrative layer forming material.

The depth in which the coloring material in the printed product is visible is greater when fine particles with an average particle size of several tens of nanometers are used for the ink receiving layer forming material compared to particles with an average particle size of several to several tens of micrometers such as particles of amorphous silica.

In any case, excellent gas blocking can be carried out if the penetrative layer material is allowed to fill the region at least up to a depth of 20 μm from the outermost surface of the ink receiving layer.

If the heating energy becomes excessive and the viscosity of the penetrative layer material decreases too much, active gases are not sufficiently blocked and can get to the coloring material located near the image formed surface because the filling density of the penetrative layer material decreases at a depth close to the uppermost surface of the ink receiving layer. Then, the effect of suppressing fading due to active gases will be reduced.

If, on the other hand, the heating energy is too small, the penetrative layer material is solidified before it penetrates into the ink receiving layer. Since the image formed surface of the ink receiving layer shows an ink injection rate that varies from place to place on the surface, the penetrative layer material is not absorbed uniformly. In other words, the thickness of the penetrative layer material that remains on the image formed surface is not uniform. Therefore, undulations can be produced on the image formed surface and the surface can appear like orange peels to the viewer's eyes. Additionally, bubbles can be generated to scatter light at the uppermost surface of the ink-jet printed product when the surface layer 2*b* and the image formed surface are not bonded well.

In view of these problems, it is preferable to use a temperature range from 100° C. to 150° C. for the heating temperature for the present invention.

As the heating ends, the molten penetrative layer forming material rapidly loses its viscosity and becomes solidified. Then, the coloring material of the printed section is surrounded by the solidified penetrative layer material so that active gases are blocked and can no longer get to the coloring material.

Finally, as the heat-resistant substrate 2*a* of the laminate film 2 is peeled off (see FIG. 3D), the surface layer 2*b* is left on the image formed surface. Thus, an image protection layer 2*p* is formed on the image formed surface.

<Laminating Apparatus>

Figure 1:
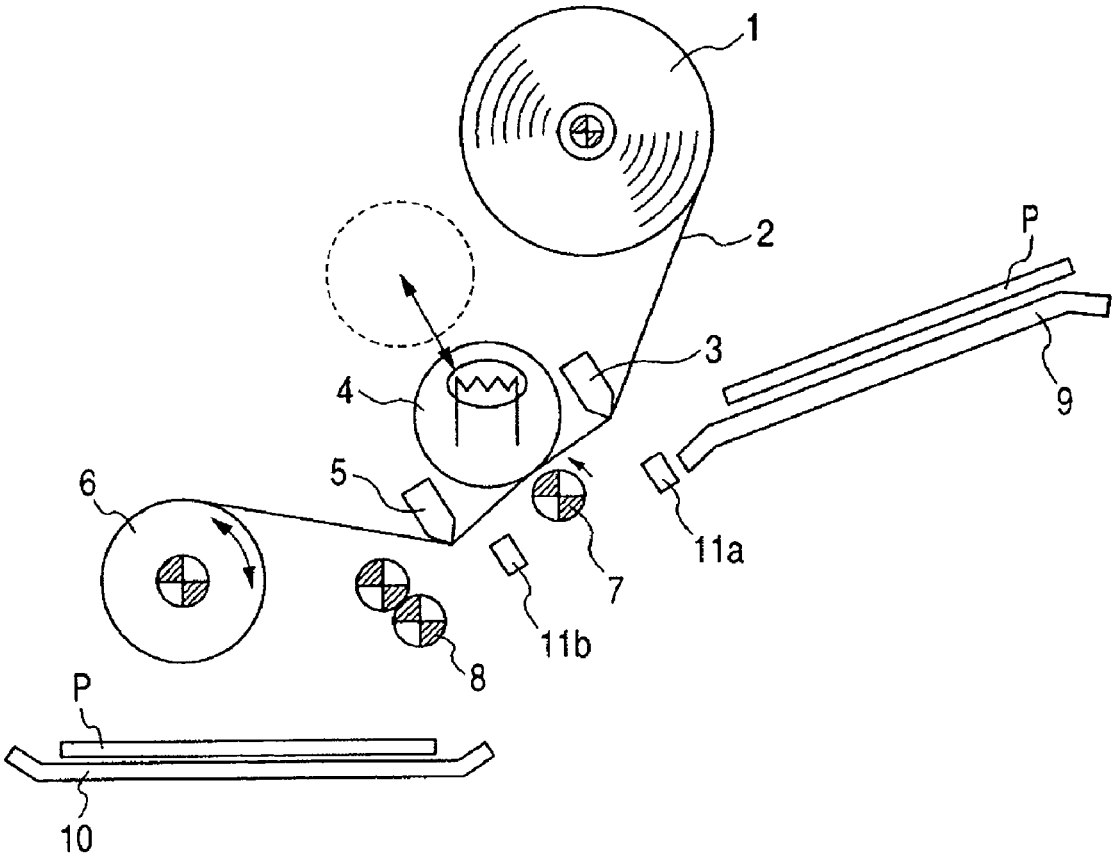
FIG. 1 is a schematic illustration of an apparatus that can be used for a method of protecting the surface of an ink-jet printed product by means of a laminate film according to the present invention.

FIG. 1 schematically illustrates a laminating apparatus for forming an image protection layer on a recording surface according to the present invention. The apparatus illustrated in FIG. 1 can carry out a lamination treatment comprising the series of operations of laying a laminate film according to the invention on an ink-jet printed product (see FIGS. 3A and 3B), heating the laminate film to drive the penetrative layer material to penetrate into the image receiving medium and to conduct bonding under pressure (see FIG. 3C) and peeling off the heat-resistant substrate after the solidification of the penetrative layer material (see FIG. 3D).

Referring to FIG. 1, 1 denotes a feed reel for feeding out a laminate film 2 from a roll of the laminate film wound with the image protection layer 2*p* facing outside. The feed reel applies backward tension to the laminate film 2 (by means of a counterclockwise (CCW) torque in FIG. 1). The laminate film 2 that is fed out from the feed reel passes a film guide 3, a heat pressing roll 4, a separator bar 5 and becomes taken up by a take-up reel 6 to which tension is applied in the film taking up direction. The heat pressing roll 4 preferably applies a linear pressure of 1.5 to 5 N/cm, more preferably 2.5 to 4 N/cm against a platen roller 7. In FIG. 1, 9 denotes a paper feed tray for feeing an ink-jet printed product P and 10 denotes a delivery tray for receiving an ink-jet printed product P that has been subjected to a penetration process, while 11*a* denotes a paper entrance detecting sensor and 11*b* denotes a paper exit detecting sensor.

As an ink-jet printed product P is put into the paper feed tray 9 and the paper entrance detecting sensor 11*a* generates a signal indicating "paper detected", the heat pressing roll 4 comes into contact with and presses against the platen roller 7 after a preset time period and, at the same time, the platen roller 7 starts rotating in CCW. While the linear velocity of rotation of the platen roller 7 may be selected within a range between 5 mm/sec and 70 mm/sec, it is preferably within a range between 10 mm/sec and 50 mm/sec. The platen roller 7 has been subjected to non-adhesion treatment so that the penetrative layer material does not adhere to the platen roller 7.

The ink-jet printed product P is heat-bonded to the laminate film 2 under pressure by means of the heat pressing roll 4 and the platen roller 7 through the image protection layer 2*p*. The ink-jet printed product P subjected to a thermally melting/penetrating treatment by the platen roller 7 is pushed out downward. If the paper exit detecting sensor 11*b* generates a signal indicating "paper detected", a pair of drawing rollers for the ink-jet printed product P starts operating. As the front end of the ink-jet printed product gets to the separator bar 5, the heat-bonded image protection layer 2*p* is transferred to the ink-jet printed product P due to the resilience of the highly rigid ink-jet printed product and the angle of the laminate film so that only the heat-resistant substrate 2*a* is taken up by the take-up reel 6.

Then, the ink-jet printed product P is pulled in by a pair of pulling rollers 8 and discharged to the delivery tray 10. The instance when the paper exit detecting sensor 11*b* detects a change from "paper detected" to "paper undetected", the heat pressing roller 4 retreats. At the same time, as the paper exit detecting sensor 11*b* detects a change from "paper detected" to "paper undetected", a timer starts operating and the laminate film is fed with a length necessary for the completion of the discharging operation. Thereafter, the platen roller 7 stops and stands still. Rear end peeling-off of the laminate film 2 and the ink-jet printed product P subjected to a thermally melting/penetrating treatment is carried out depending on the balance between the easily tearable portion of the image protection layer 2*p* along the boundary of the region that is thermally bonded under pressure and the region that is not thermally bonded under pressure and the adhesiveness of the penetrative layer 2*d*, so that the region of the penetrative layer 2*d* that is not thermally bonded to the ink-jet printed product P under pressure is held by the heat-resistant substrate 2*a*.

In the present invention, while it is preferable to use a heat pressing roll as shown in FIG. 1 as heating means from the viewpoint of transmission of heat, a laminating apparatus adapted to use a thermal head as heating means may alternatively be used if the heating rate of the heat pressing roll is low. While a lamp heater is preferably used as a heat source because it is less expensive, electromagnetic conduction may alternatively be used for the present invention.

While a system where the heat-resistant substrate 2*a* is automatically peeled off from the ink-jet printed product is described above, the heat-resistant substrate 2*a* may not be automatically peeled off depending on the material thereof. Then, it may be peeled off by hand after the above-described process.

<Laminate Film Forming Materials>

(Heat-resistant Substrate)

The heat-resistant substrate 2*a* may be made of any material so long as it can maintain the profile of the heat-resistant substrate under the above-described conditions where the image protection layer 2*p* is bonded to the ink-jet printed product by heat under pressure and can be peeled off with ease after forming the image protection layer 2*p* on the ink receiving layer of the ink-jet recording medium. Examples of materials that can be used for the heat-resistant substrate 2*a* a include films and sheets of polyesters such as polyethylene terephthalate (PET), polyethylene terephthalate/isophthalate copolymers and polybutylene terephthalate, polyolefins such as polypropylene, polyamides, polyimides, triacetyl cellulose, polyvinyl chloride, vinylidene chloride, vinyl chloride copolymers, acrylic resins and poly(ethersulfone).

The thickness of the heat-resistant substrate 2*a* is selected from a range between 2 and 50 μm from the viewpoint of transmission of heat by the heat pressing roll 4, preferably between 3 and 40 μm from the viewpoint of economy and of preventing the penetrative layer 2*d* from coming off. If the thickness is too small, the substrate can shrink when heated to degrade the quality of the laminate film after the lamination treatment.

The heat-resistant substrate 2*a* may be subjected to a surface-roughing process such as embossing or sand-blasting the surface at the side where the penetrative layer 2*d* is formed or that using a resin layer containing powder particles. If the heat-resistant substrate 2*a* is not subjected to a surface-roughing process, a printed product having a glossy image protection layer 2*p* is obtained by bonding a laminate film according to the invention to the ink-jet printed product and subsequently peeling off the heat-resistant substrate 2*a*. If, on the other hand, the heat-resistant substrate 2*a* is subjected to a surface-roughing process, a printed product having a semi-glossy or matted image protection layer 2*p* is obtained.

(Surface Layer)

The surface layer 2*b* of a laminate film according to the invention significantly affects the image quality, the gloss, the friction resistance, the water resistance and other properties of the printed product because it forms the uppermost layer of the printed product after transferring the laminate film.

From the viewpoint of image quality, it is preferable that the surface layer 2*b* is mainly composed of an amorphous polymeric material such as acryl type resins, styrene type resins, vinyl chloride type resins or vinyl acetate type resins. The use of a highly crystalline resin material is not preferable because such a material can reduce the transparency due to crystal grain boundaries.

From the viewpoint of the gloss of printed product, the glass transition temperature of the resin material that constitutes the surface layer takes an important role. To achieve a gloss level comparable to that of photographs, the smoothness of the surface layer that forms the uppermost layer is very important. If the glass transition temperature of the resin material of the surface layer is low, the softening starting temperature of the resin material also becomes low. If a resin material showing a glass transition temperature as low as room temperature is used, the resin softens in an environment of room temperature. Then, there arises a problem that the surface layer gradually traces the surface profile of the printed product with time, so that the initial gloss of the ink-jet printed product is not maintained. From the viewpoint of stably maintaining the initial profile of the surface layer in various operating environments, the glass transition temperature of the resin material of the surface layer is preferably not lower than 60° C.

From the viewpoint of friction resistance of printed products, it is important that the resin material of the surface layer shows a high membrane strength. Of the factors that significantly affect the membrane strength of a resin material, the glass transition temperature, the molecular weight, etc. are important. Generally, if the glass transition temperature of a resin material is low, the softening starting temperature of the resin material is also low. Then, the resin material can easily be deformed by external force at temperature higher than the softening starting temperature. From the viewpoint of stably maintaining the initial profile of the surface layer against external force in various operating environments, the glass transition temperature of the resin material of the surface layer is preferably not lower than 60° C. Next, as for the molecular weight of resin material, the membrane strength of a resin material is low if the molecular weight of the material is low because the effect of entanglement of polymers is reduced. Sine the surface layer can be directly subjected to external force, it is important for the surface to show a sufficiently high membrane strength. From the viewpoint of membrane strength, the molecular weight of the resin material of the surface layer is preferably not lower than 10,000 in terms of weight average molecular weight as determined in terms of polystyrene.

Now, the composition of the resin material of the surface layer will be described below. For the present invention, the resin material can be prepared by selecting monomers from those listed below so as to meet the above-described characteristic requirements. Alternatively, a commercially available material that meets the above listed characteristic requirements may appropriately be selected for the surface layer.

As for acryl type resins, homopolymers of (meth)acrylic esters or copolymers of (meth)acrylic esters and monomers that can be copolymerized with them (to be referred to simply as (meth)acrylic ester type polymers hereinafter) is preferable. Note that the expression of (meth)acrylic ester refers to acrylic ester or methacrylic ester.

Specific examples of (meth)acrylic ester monomers that can be used to manufacture (meth)acrylic ester type polymers include methyl (meth)acrylate, ethyl (meth)acrylate, isopropyl (meth)acrylate, n-butyl (meth)acrylate, n-hexyl (meth) acrylate, n-octyl (meth)acrylate, 2-ethylhexyl (meth)acrylate, isononyl (meth)acrylate and lauryl (meth)acrylate. The (meth)acrylic ester type polymers can be obtained by singly polymerizing the above listed (meth)acrylic ester monomers or by copolymerizing such monomers and other monomers that can be copolymerized with them.

Specific examples of monomers that can be copolymerized with (meth)acrylic ester for the purpose of the present invention include unsaturated carboxylic acids such as (meth) acrylic acid, crotonic acid, maleic acid, fumaric acid and itaconic acid, monomers having a hydroxyl group such as hydroxylethyl (meth)acrylate, hydroxylpropyl (meth)acrylate and hydroxylbutyl (meth)acrylate, monomers having an alkoxy group such as methoxyethyl (meth)acrylate and ethoxyethyl (meth)acrylate, monomers having a glycidyl group such as glycidyl (meth)acrylate and allyl glycidyl ether, monomers having a cyano group such as (meth)acrylonitrile, styrene type monomers such as styrene and α-methyl styrene, monomers having an aromatic ring such as phenyl (meth)acrylate and benzyl (meth)acrylate, monomers having an amide group such as (meth)acrylamide, monomers having an N-alkoxy group or an N-alkoxyalkyl group such as N-methoxymethyl(meth)acrylamide, N-methoxyethyl (meth)acrylamide, monomers having an N-alkylol group such as N-methylol(meth)acrylamide and N-butylol(meth) acrylamide, vinyl halide type monomers such as vinyl fluoride, vinyl chloride and vinyl bromide, monomers having a group with a halogen atom bonded thereto such as allyl chloride, 2-chloroethyl (meth)acrylate and chloromethylstyrene and olefin type monomers such as ethylene, propylene and butadiene.

(Meth)acrylic ester type polymers containing monomers having a reactive functional group selected from the above listed monomers can be partially cross-linked for use by utilizing the functional group. Examples of styrene type resins that can be used for the surface layer 2*b* of a laminate film according to the invention include VINYBLAN 2730 (trade name, available from Nissin Chemical Industry Co., Ltd.). Examples of vinyl chloride type resins that can be used for the surface layer 2*b* of a laminate film according to the invention include VINYBLAN 270 (trade name, available from Nissin Chemical Industry Co., Ltd.). Examples of vinyl acetate type resins that can be used for the surface layer 2*b* of a laminate film according to the invention include VINYBLAN 1122 (trade name, available from Nissin Chemical Industry Co., Ltd.).

The surface layer 2*b* of a laminate film according to the invention can be formed typically by way of a coating process as described below, using a coating liquid prepared by using a resin solution obtained by dissolving the above-described resin materials into an organic solvent, an emulsion of the above-described polymeric substances prepared by emulsion polymerization or an aqueous dispersion obtained by synthesizing the above-described polymeric substances and dispersing them into an aqueous medium by way of suspension or emulsification (emulsions may be included in this category).

The surface layer 2*b* of a laminate film according to the invention can be formed by coating the surface of a heat-resistant substrate of a material as described above with a coating liquid as described above by means of a coating technique selected from roll coating, rod bar coating, spray coating, air knife coating, slot die coating and so on and drying the applied coating liquid.

The image protection layer 2*p* of a laminate film according to the present invention can be formed by forming an intermediate layer 2*c* and a penetrative layer 2*d* on the surface layer 2*b* formed in the above-described manner. The surface layer 2*b* is required to have a thickness that is sufficient for preventing cracks caused by internal stress of itself. On the other hand, while it may not be automatically peeled off when the thickness is made large, there are applications where improvement of the gloss is important. Taking these circumstances into consideration, the thickness of the surface layer 2*b* is selected from a range between 0.5 and 15 μm, preferably from a range between 1.0 and 10 μm.

(Intermediate Layer)

One of the remarkable characteristic features of a laminate film according to the invention is that an intermediate layer 2*c* is arranged between the above-described surface layer 2*b* and the penetrative layer 2*d* to form a multilayer structure, which will be described in greater detail hereinafter. While the material of the penetrative layer 2*d*, which will be described in greater detail hereinafter, is quickly melted to become a liquid or fluid state when heated to penetrate into the ink-receiving layer, the surface layer 2*b* needs to be made of a material that is hardly deformed by heat from the viewpoint of satisfying the requirement of protecting the surface of the laminate film as pointed out earlier. As a result of intensive research efforts, the inventors of the present invention came to find that the use of an intermediate layer is indispensable for the purpose of making the layers showing such contradictory thermal characteristics integrally function as a laminate transfer layer. Thus, one of the characteristic features of the laminate film of the present invention is the provision of the intermediate layer 2*c* that has a thermally softening property similarly to the above-mentioned surface layer 2*b* and that is comprised of a material having a glass transition temperature lower than that of the surface layer 2*b*. If an intermediate layer is not provided, it is difficult to successfully conduct a lamination treatment because the surface layer and the penetrative layer are apt to be separated from each other in a laminate transferring process (a so-called ikiwakare phenomenon) or the penetrative layer does not operate satisfactorily and may cause a whitening phenomenon due to bubbles when the lamination treatment is conducted under conditions that can prevent such separation. Thus it is difficult to carry out a satisfactory lamination treatment.

Important functional features required of the material of the intermediate layer include that the material of the intermediate layer 2*c* is appropriately deformed and remains on the surface of the ink receiving layer when heated (in other words, it does not penetrate into the ink receiving layer), and that the adhesion of the material of the intermediate layer 2*c* relative to that of the surface layer 2*b* is stronger than the adhesion of the material of the surface layer 2*b* relative to that of the heat-resistant substrate 2*a* and the intermediate layer 2*c* adheres well to the ink receiving layer. On the other hand, it is also found that cracks can appear on the surface of the printed product that is subjected to a lamination treatment to damage the image holding performance of the laminate film when the product is left in an ordinary environment. As for the mechanism of appearance of cracks, a conceivable theory is that, when the printed product is left in various temperature/humidity environments, the base paper material of the ink-jet recording medium causes expansion/shrinkage due to moisture absorption and/or thermal expansion, thereby giving rise to tensile stress between the intermediate layer and the surface layer. As an easily deformable intermediate layer is arranged under the surface layer, the intermediate layer may follow the expansion/shrinkage of the base paper material to consequently give rise to tensile stress between the intermediate layer and the surface layer that is hardly deformable, which ends up in appearance of cracks.

As a result of intensive research efforts of looking into the intermediate layer, the inventors of the present invention found the following.

It is preferable to use a material showing such a glass transition characteristic that it is appropriately softened in the lamination treatment but not turned into a molten state (having no melting point) for the intermediate layer 2*c*. Additionally, the glass transition temperature of the material of the intermediate layer is preferably lower than the glass transition temperature of the material of the surface layer. Materials that can be used for the intermediate layer 2*c* include acryl type resins, urethane type resins, polyester type resins, vinyl acetate type resins, vinyl chloride type resins, ethylene/vinyl acetate copolymer resins, polyamide resins, polyolefin resins. These materials are suitable because they are also used for adhesives and show an excellent effect of tightly adhering to the surface layer 2*b* and the ink receiving layer. Of the above listed materials, adhesive resin materials containing an acryl type resin is particularly preferable because the produced intermediate layer 2*c* is highly transparent. Adhesive resin materials containing an acryl type resin are also preferable from the viewpoint of affinity for the surface of the ink-jet recording medium.

The inventors of the present invention also found that the material properties of the intermediate layer 2*c* can be controlled by adjusting the glass transition temperature thereof in order to control the softening degree of the intermediate layer in the lamination treatment and to suppress appearance of cracks when the printed product is left in an environment as described above. The glass transition temperature is preferably not lower than 35° C. and not higher than 55° C. If the glass transition temperature of the intermediate layer 2*c* is lower than 35° C., while it is possible to suppress the above-described ikiwakare phenomenon of the surface layer and the adhesive layer, cracks can appear because the intermediate layer can easily be deformed. If, on the other hand, the glass transition temperature of the intermediate layer 2*c* is higher than 55° C., it is difficult to suppress the ikiwakare phenomenon because the laminate film is not deformed sufficiently by heating at the time of transferring the laminate film.

Examples of acryl type monomers that can be used particularly preferably for producing acryl type resins for the purpose of preparing an adhesive resin material to be used for the intermediate layer include alkyl ester monomers such as methyl acrylate, ethyl acrylate, propyl acrylate, isopropyl acrylate, butyl acrylate, isobutyl acrylate, pentyl acrylate, hexyl acrylate, heptyl acrylate, octyl acrylate, 2-ethylhexyl acrylate and nonyl acrylate and alkoxyalkyl acrylates such as 2-ethoxyethyl acrylate and 3-ethoxypropyl acrylate. Emulsions of an adhesive resin material that contains a polymer substance such as acryl type resins can be prepared by any of well known techniques.

The intermediate layer 2*c* of a laminate film according to the invention can be formed by applying a coating liquid containing a resin material as described above onto the surface layer 2*b* by means of a coating technique selected from roll coating, rod bar coating, spray coating, air knife coating, slot die coating and so on and drying the applied coating liquid as in the case of forming the surface layer 2*b*.

The membrane weight of the intermediate layer 2*c* of a laminate film according to the invention is preferably between 2 and 15 g/m$^2$, more preferably between 2 and 10 g/m$^2$. The effect of broadening the process margin is not sufficient and hence is not preferable when the membrane weight of the intermediate layer 2*c* is lower than 2 g/m$^2$. On the other hand, the conduction of heat to the penetrative layer 2*d* becomes low to reduce the effect of melting the penetrative layer 2*d* and hence is not preferable when the membrane weight of the intermediate layer 2*c* is higher than 15 g/m$^2$. By the provision of the intermediate layer as described above, the process margin is broadened to make it possible to obtain a laminate film that does not produce any cracks in the printed product under conditions in which the product is left.

(Penetrative Layer)

The penetrative layer 2*d* has a thermally melting property. The thermally melting property represents such a nature that when a component material of the layer is heated to a temperature above the melting temperature, the material becomes a melt liquid state. Resin materials that show a viscosity drop when heated to a temperature above the melting temperature to become a melt liquid state are highly crystalline and have a low molecular weight. When the penetrative layer 2*d* is mainly comprised of a material having a thermally melting property and a binder component (base polymer) for controlling the melt property and membrane strength of the overall layer, the interlayer adhesion and so on, both a thermally melting property when heated as well as stable retainability of the layer at ordinary temperature can be achieved.

The penetrative layer 2*d* that characterizes a laminate film according to the invention is formed by using a wax and a base polymer as principal ingredients. Natural waxes such as paraffin wax and carnauba wax and synthetic waxes such as polyethylene wax and base polymers such as ethylene-vinyl acetate type base polymers, polyester type base polymers and polyolefin type base polymers can be used for the penetrative layer 2*d*. According to the present invention, the penetrative layer 2*d* is used for the purpose of controlling the viscosity at the time of being molten and controlling the adhesiveness to the intermediate layer. If necessary, a stickiness-providing material may be added for the purpose of improving the adhesion to the intermediate layer and the ink receiving layer.

In the present invention, the penetrative layer is molten to become less viscous and turned into liquid or fluid when the laminate film is heat-bonded to the image formed surface under pressure so that it penetrates into the porous ink receiving layer. Therefore, it is necessary to control the viscosity of the penetrative layer. Normally, the heating temperature in the lamination treatment is not higher than 150° C. from the viewpoint of avoiding damages to the heat-resistant substrate by heat. As a result of intensive research efforts, the inventors of the present invention found that the ink receiving layer can be optimally filled with the material of the penetrative layer by adjusting the viscosity of the latter to be within a range between 500 mPa·sec and 1,200 mPa·sec at temperature not lower than 100° C. and not higher than 150° C. Preferably, the viscosity of the penetrative layer is adjusted so as to be within a range between 700 mPa·sec and 1,000 mPa·sec. If the molten viscosity is lower than 500 mPa·sec, the material of the penetrative layer is diffused into the entire image receiving layer of the image receiving medium when it is molten to reduce the penetration density at the surface that contributes to the optical density for viewers. As a result, it becomes difficult to prevent fading of the image by active gases. If, to the contrary, the molten viscosity is higher than 1,200 mPa·sec, the fluidity of the material of the penetrative layer is too low when it is molten so that the material does not penetrate into the inside of the ink receiving layer sufficiently and hence such a high viscosity is not preferable.

The penetrative layer 2*d* of a laminate film according to the invention is formed by applying a coating liquid containing the above-described resin material onto the surface layer 2*b* by means of a coating technique selected from roll coating, rod bar coating, spray coating, air knife coating, slot die coating and so on and drying the applied coating liquid as in the case of forming the preceding two layers.

The membrane weight of the penetrative layer 2*d* of a laminate film according to the invention is preferably between 2 and 15 g/m$^2$, more preferably between 4 and 12 g/m$^2$. If the membrane weight is lower than 2 g/m$^2$, the material of the penetrative layer is diffused at the time of penetration when it is molten. Therefore, the use of such a membrane weight is not preferable.

(Recording Medium)

For the present invention, the use of void absorption type ink-jet recording mediums is preferable for ink-jet recording mediums. A void absorption type ink-jet recording medium is typically prepared by forming an ink receiving layer that contains inorganic or organic fine particles and binder resin on a substrate. Examples of such image receiving mediums include non-cast coated glossy paper, cast coated paper and mat coated paper. While the surface properties and the absorption characteristics of void absorption type ink-jet recording mediums may vary depending on the material of the ink receiving layer, the particle size of the fine particles and the technique of coating the underlying plain paper, the gas resistance of the printed product is remarkably improved by the material of the penetrative layer when a laminate film according to the invention is used for treatment because such ink-jet recording mediums are of the void absorption type.

Glossy paper usable in the present invention is formed by using sheet-shaped substance such as paper or thermoplastic resin film for the support material (base paper). Materials that can be used for the support material is not subjected to any limitations and include paper, polyester, polystyrene and polyethylene. Paper coated with a thermoplastic resin film may also be used. While the thickness of the support material is not subjected to any specific limitations, it is generally between 150 μm and 300 μm.

When forming an ink receiving layer on such a support material by using a silica sol type material, dry silica produced by a gas phase method and a binder for binding it to the support material are used; if necessary, a white pigment is also used. As dry silica, ultrafine particles of silica having an average primary particle size between 12 nm and 20 nm that are prepared by burning silicon tetrachloride with hydrogen and oxygen shows an excellent color density and an excellent ink absorbing property. White pigments that can be used include inorganic pigments such as calcium carbonate, kaolin, talc and zinc oxide and organic pigments such as urea resins and polystyrene resins. Adhesive agents that can be used include starches such as starch oxide and dextrin, casein, gelatin, polyvinyl alcohol and derivatives thereof and vinyl type copolymerized latexes such as ethylene-vinyl acetate copolymer. These adhesive agents are preferably used in an amount of 2 to 50 parts with respect to 100 parts of the pigment, although the ratio is not subjected to any particular limitations so long as it is used in an amount sufficient for binding the pigment. If appropriate, a pigment dispersing agent, a thickener, an antifoaming agent and/or a lubricating agent may be added without any problem.

When applying a coating liquid containing a pigment as described above to the support material, a coater selected from a group of popular coaters including a blade coater, an air knife coater, a roller coater, a brush coater, a curtain coater, a bar coater, a gravure coater and a sprayer may be used.

The above-described dry silica may be replaced by alumina sol, alumina-silica composite sol or a gas phase alumina.

EXAMPLES

Now, the present invention will be described further by way of examples and comparative examples. In the following description, "parts" and "%" refers respectively to parts by mass and mass % unless noted otherwise.

[1] Preparation of Ink-jet Recording Medium and Production of Printed Product

An ink receiving layer was formed by applying an application liquid as described below onto a 180 μm thick base paper by means of a curtain coater and drying it so as to obtain a dry solid matter content of 20 g/m$^2$.

(Application Liquid)

| | |
|---|---|
| polyvinyl alcohol | 10 mass % |
| gas phase silica (AEROSIL, trade name, available from Nippon Aerosil Co., Ltd, primary particle size: 12 nm) | 15 mass % |
| water | 75 mass % |

The ink receiving layer showed a thickness of 20 μm. An image printing operation was conducted on the obtained ink-jet recording medium by means of an ink-jet printer (BJ-F870, trade name, available from Canon). A black image was formed with O. D=2.2 that is the highest density that can be realized by injecting ink into the ink receiving layer by giving (R, G, B)=(0, 0, 0) as RGB data.

[2] Laminate Film

Example 1

Firstly, the materials for forming a laminate film of this example were prepared in a manner as described below.

coating liquid 1: Acrylic Emulsion T371 (trade name, available from JSR Corporation, Tg=85° C., solid content: 40%) was used as coating liquid 1.

coating liquid 2: Acrylic resin DIANAL L-637 (trade name, available from Mitsubishi Rayon Co., Ltd., Tg=42° C., solid content: 40%) was used as coating liquid 2.

penetrative material 1: 40 parts of ethylene-vinyl acetate copolymer resin EVAFLEX (registered trademark) 220 (available from Dupont-Mitsui Polychemicals Co., Ltd., melting point: 65° C.) was added to 100 parts (solid matter weight) of polyethylene wax SLIPAID SL31 (trade name, available from Elementis Japan KK, melting point: 105° C.) and the mixture was melted by heating. When the viscosity was observed by means of Viscometer LVT (trade name, available from Brookfield Co.), it was found that the molten viscosity was 800 mPa·sec at 100° C.

heat-resistant substrate 1: PET film, Lumirror (registered trademark) S10 (available from Toray Industries, Inc.) (thickness: 12 μm) was used as heat-resistant substrate 1.

The coating liquid 1 was applied to the heat-resistant substrate 1 by slot die coating and dried to form a surface layer with a dry weight of 1.2 g/m$^2$. Subsequently, the coating liquid 2 was applied by slot die coating and dried to form an intermediate layer with a dry weight of 2 g/m$^2$. Thereafter, the penetrative material 1 was applied and dried to form a penetrative layer with a dry weight of 6 g/m$^2$ and produce Laminate Film 1 of this example.

Example 2

Laminate Film 2 was obtained in this example as in Example 1 except the coating liquid 2 was applied and dried to form an intermediate layer with a dry weight of 1 g/m$^2$.

Example 3

Laminate Film 3 was obtained in this example as in Example 1 except the coating liquid 2 was applied and dried to form an intermediate layer with a dry weight of 3 g/m$^2$.

Example 4

Laminate Film 4 was obtained in this example as in Example 1 except the coating liquid 2 was applied and dried to form an intermediate layer with a dry weight of 5 g/m$^2$.

Example 5

Laminate Film 5 was obtained in this example as in Example 1 except that the coating liquid 2 was applied and dried to form an intermediate layer with a dry weight of 7 g/m$^2$.

Example 6 coating liquid 3: Acrylic emulsion AE-116 (trade name, available from JSR Corporation, Tg=50° C., solid content: 40%) was used as coating liquid 3. Laminate Film 6 was obtained in this example as in Example 1 except that the coating liquid 3 was used in place of the coating liquid 2 to form an intermediate layer and hence the intermediate layer of this example differed from that of Example 1.

Example 7 coating liquid 4: Acrylic emulsion VINYBLAN 2706 (trade name, available from Nissin Chemical Industry Co., Ltd, Tg=15° C., solid content: 40%) was used as coating liquid 4. Laminate Film 7 was obtained in this example as in Example 1 except that the coating liquid 4 was used in place of the coating liquid 2 to form an intermediate layer and hence the intermediate layer of this example differed from that of Example 1.

Example 8 coating liquid 5: Styrene acryl A-5045 (trade name, available from Kusumoto Chemicals, Ltd, Tg=35° C., solid content: 40%) was used as coating liquid 5. Laminate Film 8 was obtained in this example as in Example 1 except that the coating liquid 5 was used in place of the coating liquid 2 to form an intermediate layer and hence the intermediate layer of this example differed from that of Example 1.

Comparative Example 1

Laminate Film 9 was obtained in this example by following the process of producing the laminate film 1 in Example 1 except that no intermediate layer was formed in Laminate Film 9.

Comparative Example 2

Laminate Film 10 was obtained in this example by following the process of producing the laminate film 1 in Example 1 except that no penetrative layer was formed in Laminate Film 10.

[3] Lamination Treatment of Ink-jet Printed Product

A lamination treatment (penetration process) was conducted on the ink-jet printed products obtained in [1] by using Laminate Films 1 through 10 of Examples and Comparative Examples respectively. More specifically, using an apparatus as shown in FIG. 1 the laminate film was heated from the side of the heat-resistant substrate by means of the heat pressing roll 4. The platen roller 7 with a diameter of 12 mm located on the side of the printed product was not heated. The heating temperature of the heat pressing roll 4 was 120° C. The linear pressure applied onto the platen roller by the heat pressing roll 4 was 1.5 N/cm. The feeding rate was 40 mm/sec. After heat pressing, the substrate was peeled off to obtain a printed product on which an image protection layer was formed.

<Evaluation>

(1) Evaluation of Process Margin

Laminate Film 1 of Example 1 and Laminate Film 9 of Comparative Example 1 were used to conduct the lamination treatment of [3], in which the material of the penetrative layer was caused to penetrate. In the treatment the heating temperature of the heat pressing roll 4 was varied to 90° C., 100° C., 120° C., 140° C. and 150° C. After the heat pressing, the heat-resistant substrate was peeled off. Each of the printed products where an image protection layer was formed was visually evaluated to determine if the image protection layer was formed appropriately or not by using the rating criteria as shown below.

○: The image protection layer was properly transferred onto the surface of the printed product.

×1: Bubbles and orange peels were generated on the surface of the printed product.

×2: Ikiwakare phenomenon appeared where the surface layer was not transferred.

TABLE 1

Difference in whitening (process margin) due to presence or absence of an intermediate layer

| | heating temperature (° C.) | | | | |
|---|---|---|---|---|---|
| | 90 | 100 | 120 | 140 | 150 |
| Example 1 | x1 | ○ | ○ | ○ | ○ |
| Example 2 | x1 | x1 | ○ | ○ | ○ |
| Example 3 | x1 | ○ | ○ | ○ | ○ |
| Example 4 | x1 | ○ | ○ | ○ | ○ |
| Example 5 | x1 | ○ | ○ | ○ | ○ |
| Example 6 | x1 | ○ | ○ | ○ | ○ |
| Example 7 | x1 | x1 | ○ | ○ | ○ |
| Example 8 | x1 | ○ | ○ | ○ | ○ |
| Com. Ex 1 | x1 | x2 | x2 | x2 | x2 |

It is clear from Table 1 that an image protection layer is properly formed to broaden the process margin by arranging an intermediate layer.

(2) Evaluation of Cracks

The printed products of Examples 1 through 8 that were obtained in [3] above and subjected to a lamination treatment were put in three different environments including a low temperature/low humidity environment (15° C.-10% RH), an ordinary temperature/ordinary humidity environment (25° C.-50% RH) and a high temperature/high humidity environment (35° C.-80% RH) for a week, and then cracks, if any, produced due to temperature and humidity were visually observed. The images left in the above-described environments were visually observed and evaluated by using the rating criteria as shown below.

◎: No cracks produced in the three environments.

○: Minute cracks were visible but the specimen could feasibly be used in practical applications.

Δ: Cracks were produced in at least one of the three environments.

TABLE 2

| | Example 1 | Example 2 | Example 3 | Example 4 |
|---|---|---|---|---|
| cracks | ◎ | ○ | ◎ | ◎ |
| | Example 5 | Example 6 | Example 7 | Example 8 |
| cracks | ◎ | ◎ | Δ | ○ |

(3) Evaluation of Fading Generated from the Sides of the Edges of Printed Product After the lamination treatment, using the laminate films of the examples and the comparative examples, the blank regions of edges were cut away and the fading generated from the sides of the edges of the obtained printed product were tested by means of an ozone weather meter (OMS-H: trade name, available from Suga Test Instruments Co., Ltd.). The test condition was in an environment of 40° C.-55% RH with an ozone concentration of 2.5 ppm for 10 hours. Each printed product was visually observed before and after the exposure to ozone gas and evaluated by using the rating criteria as shown below.

○: No fading was observed from the edges of the printed product.

Δ: Fading was observed from the edges of the printed product by not more than 1 mm.

×: Fading was observed by more than 1 mm from the edges of the printed product.

As a result of the evaluation, Examples 1 through 8 were rated as "◎" but Comparative Example 2 that did not have any penetrative layer was rated as "x" and Comparative Example 1 that did not have any intermediate layer was rated as "Δ". This may be because although the material of the penetrative layer is liquefied and penetrates into the ink receiving layer when a penetrative layer was provided without any intermediate layer, it is not held in an upper part of the ink receiving layer that is close to the surface of the ink receiving layer but is held in an intermediate part and a bottom part of the ink receiving layer, so that the molecules of the dye are partly exposed in an upper part of the ink receiving layer and attacked by ozone to become faded.

When any of the laminate films of the above-described examples was used for a lamination treatment, a laminated printed product is obtained by peeling off the heat-resistant substrate 1 after heating.

This application claims priority from Japanese Patent Application Nos. 2004-374477 filed on Dec. 24, 2004 and 2005-365915 filed on Dec. 20, 2005, which are hereby incorporated by reference herein.

What is claimed is:

1. A laminate film, for protecting a printed image formed on a recording medium having a porous ink receiving layer by an ink-jet recording system, the laminate film comprising:

a heat-resistant substrate, having formed thereon:

a surface layer;

an intermediate layer; and a penetrative layer, in that order;

wherein the surface layer and the intermediate layer have a thermally softening property that causes the surface layer and the intermediate layer to soften upon application of heat;

wherein the intermediate layer has a glass transition temperature lower than that of the surface layer;

wherein the penetrative layer has a thermally melting property that causes the penetrative layer to melt into a recording medium when a recording medium is placed in contact with the penetrative layer and said heat is applied;

wherein the penetrative layer is comprised of molten property materials that have a viscosity within a range between 500 mPa·sec and 1200 mPa·sec at a temperature not lower than 100° C. and not higher than 150° C.; and wherein the surface layer acts as a protection layer to protect a printed image formed on a recording medium upon removal of the heat-resistant substrate.

2. The laminate film according to claim 1, wherein the material of the intermediate layer has a glass transition temperature of not lower than 35° C.

3. The laminate film according to claim 2, wherein the material of the intermediate layer has a glass transition temperature of not higher than 55° C.

4. The laminate film according to claim 1, wherein the intermediate layer has a membrane weight of not less than 2 $g/m_2$.

5. The laminate film according to claim 4, wherein the thickness of the surface layer is from a range between 0.5 and 15 μm and the penetrative layer has a membrane weight of not less than 2 $g/m_2$.

6. The laminate film according to claim 1, wherein the material of the surface layer is composed of transparent resin materials that has a glass transition temperature of not lower than 60° C.

7. A composite structure including a laminate film and a recording medium having an image formed thereon by an ink-jet recording medium, the composite structure comprising:

a recording medium including an ink receiving layer that receives ink from an ink-ket recording system; and a laminate film heat bonded to the recording medium;

wherein the laminate film includes a heat-resistant substrate, having formed thereon: a surface layer; an intermediate layer; and, a penetrative layer, in that order;

wherein the surface layer and the intermediate layer have a thermally softening property that causes the surface layer and the intermediate layer to soften upon application of heat;

wherein the intermediate layer has a glass transition temperature lower than that of the surface layer;

wherein the penetrative layer has a thermally melting property that causes the penetrative layer to melt upon application of said heat into the recording medium when the laminate film is bonded to the recording medium.

8. The composite structure according to claim 7, wherein the penetrative layer is comprised of molten property materials that have a viscosity within a range between 500 mPa·sec and 1200 mPa·sec at a temperature not lower than 100° C. and not higher than 150° C.

9. The composite structure according to claim 7, wherein the material of the intermediate layer has a glass transition temperature of not lower than 35° C.

10. The composite structure according to claim 7, wherein the intermediate layer has a membrane weight of not less than 2 $g/m_2$.

11. The composite structure according to claim 7, wherein the material of the intermediate layer has a glass transition temperature of not higher than 55° C.

12. The composite structure according to claim 7 wherein the material of the surface layer is composed of transparent resin materials that has a glass transition temperature of not lower than 60° C.

13. The composite structure according to claim 7, wherein the thickness of the surface layer is from a range between 0.5 and 15 μm and the penetrative layer has a membrane weight of not less than 2 $g/m_2$.

* * * * *